US007909747B1

(12) United States Patent
LaCaze

(10) Patent No.: US 7,909,747 B1
(45) Date of Patent: Mar. 22, 2011

(54) EXERCISE DEVICE AND METHOD

(76) Inventor: Joe LaCaze, Lafayette, LA (US)

( * ) Notice: Subject to any disclaimer, the term of this patent is extended or adjusted under 35 U.S.C. 154(b) by 89 days.

(21) Appl. No.: 12/263,695

(22) Filed: Nov. 3, 2008

(51) Int. Cl.
*A63B 26/00* (2006.01)

(52) U.S. Cl. ..... 482/142; 482/146

(58) Field of Classification Search ..... 482/146–147, 482/34, 148, 79–80, 139, 91–92, 51
See application file for complete search history.

(56) References Cited

U.S. PATENT DOCUMENTS

| | | | | |
|---|---|---|---|---|
| 3,372,930 | A * | 3/1968 | Sertich | 473/452 |
| 3,702,188 | A | 11/1972 | Phillips | |
| 4,998,720 | A | 3/1991 | Kim | |
| 5,344,376 | A * | 9/1994 | Bostic et al. | 482/118 |
| 5,419,747 | A | 5/1995 | Piaget et al. | |
| 5,447,484 | A * | 9/1995 | Chandler | 482/146 |
| 5,518,476 | A * | 5/1996 | McLeon | 482/79 |
| 5,593,374 | A | 1/1997 | Gvoich | |
| 5,762,565 | A | 6/1998 | Milam et al. | |
| 5,865,710 | A * | 2/1999 | Wilson-Hyde | 482/52 |
| 5,941,807 | A * | 8/1999 | Cassidy et al. | 482/146 |
| 6,176,817 | B1 * | 1/2001 | Carey et al. | 482/146 |
| 6,676,579 | B1 * | 1/2004 | Lin | 482/146 |
| 6,723,004 | B1 | 4/2004 | Florian | |
| 7,008,359 | B2 | 3/2006 | Fan et al. | |
| 7,169,098 | B1 * | 1/2007 | McGanty | 482/146 |
| 7,331,910 | B2 * | 2/2008 | Vallone et al. | 482/128 |
| 7,357,759 | B2 * | 4/2008 | Bonnell | 482/72 |
| 7,364,534 | B2 * | 4/2008 | Zoller et al. | 482/80 |
| 7,520,840 | B2 * | 4/2009 | Shifferaw | 482/52 |
| 7,621,861 | B1 * | 11/2009 | Kalember et al. | 482/147 |
| 7,666,121 | B2 * | 2/2010 | Zhou | 482/51 |
| 7,666,127 | B2 * | 2/2010 | Sheets | 482/146 |
| 2001/0015567 | A1 * | 8/2001 | Tholkes et al. | 297/172 |
| 2002/0177511 | A1 * | 11/2002 | Jang | 482/146 |
| 2003/0073550 | A1 * | 4/2003 | Hsu | 482/142 |
| 2005/0119591 | A1 * | 6/2005 | Vardy | 600/587 |
| 2006/0003877 | A1 * | 1/2006 | Harmon | 482/142 |
| 2006/0019805 | A1 * | 1/2006 | Heck | 482/121 |
| 2006/0084554 | A1 * | 4/2006 | Bement | 482/79 |
| 2006/0217242 | A1 * | 9/2006 | Karpachev | 482/77 |
| 2007/0027009 | A1 * | 2/2007 | Arnold | 482/146 |
| 2007/0173376 | A1 * | 7/2007 | van der Meer | 482/1 |
| 2007/0184953 | A1 * | 8/2007 | Luberski et al. | 482/146 |
| 2007/0213179 | A1 * | 9/2007 | Trandafir | 482/51 |
| 2007/0219052 | A1 * | 9/2007 | Schuurman et al. | 482/1 |
| 2007/0259763 | A1 | 11/2007 | McKeown et al. | |
| 2008/0020915 | A1 * | 1/2008 | Pacheco et al. | 482/146 |
| 2008/0058167 | A1 * | 3/2008 | Schippers | 482/51 |
| 2008/0280740 | A1 * | 11/2008 | Knecht et al. | 482/146 |
| 2009/0111660 | A1 * | 4/2009 | Snow et al. | 482/38 |
| 2009/0156378 | A1 * | 6/2009 | Wang | 482/138 |
| 2009/0163337 | A1 * | 6/2009 | Petrakov | 482/147 |

* cited by examiner

*Primary Examiner* — Lori Baker

(57) ABSTRACT

A method and apparatus for exercise of the gluteus medius and gluteus minimus muscle complex against resistance in internal rotation, the tibialis posterior in internal rotation and inversion, the piriformis muscle and its synergists in external rotation and the peroneal muscles in external rotation and eversion is disclosed. The apparatus is comprised of a stable base having a rotatable foot support plate mounted on the base upward at a predetermined angle from the horizontal in order to dorsiflex the user's foot. Means to adjust the rotational resistance of the rotatable foot support plate is provided. The device includes a back support to assist in maintaining the user's pelvis in a neutral position. The device provides internal and external resistance to isolate and exercise the gluteus medius and gluteus minimus muscle complex or the piriformis and synergists while the user is in a standing position. It further provides internal and external resistance to exercise the tibialis posterior and the peroneals in either the standing or seated position.

29 Claims, 5 Drawing Sheets

EXERCISE DEVICE AND METHOD

FIELD OF INVENTION

The invention relates to exercise devices and more particularly relates to a device for applying internal rotation exercise against resistance for the gluteus medius/gluteus minimus muscle complex and the posterior tibialis muscle, while in plantarflexion. It is also intended for external rotation of the external rotators of the hip, to include the piriformis muscle, and is likewise intended for external rotation with added eversion for the peroneals muscles.

BACKGROUND

Individuals may benefit from improving the structure of the hip and pelvic region. The pelvis transmits energy from the lower body to the upper body. When there is a proper relationship between the pelvis and hip joints, energy is transmitted more efficiently. Reinforcement of this proper relationship will lead to more energy transmission in an individual and reduce the chance of setting up injury scenarios during exercise situations and in normal daily living activities.

Working the muscles of the pelvis/hip complex against resistance, in their primary range of motion is thought to be the best method to maintain the proper relationship between the pelvis and hip joints. The pelvis/hip complex includes the gluteus medius and the gluteus minimus which are critical to the muscle balance of the hip and low back region. This muscle complex plays a critical role in the position of the sacrum, which in turn drives the position of the pelvis, which in turn drives the position of the rest of the spine, both lower and upper.

The posterior tibialis is an important muscle located behind the tibia. It attaches to six bones in the foot. When the posterior tibialis is weak, the arch of the foot may be adversely affected due to the way the muscle is positioned and attached to the foot. A long and weak tibialis posterior will promote hyperpronation syndrome, i.e., when the arch of the foot drops to the inside.

The primary range of motion for the gluteus medius, the gluteus minimus, and the posterior tibialis is internal rotation. Functional exercises for these muscles exist, but none are known to exercise these muscles groups against resistance in internal rotation. Typically functional exercises for these muscle groups employ exercise resistance in abduction, e.g., away from the midpoint or midline of the body or a limb, and in stabilization scenarios where the limb is placed in resistance without movement. Applying resistance in abduction and stabilization exercises for these muscle groups does not address the stress and strain applied to the muscle groups encountered during their use in many active motion situations, such as during walking, running, cycling, jumping, skipping, swimming or other normal movements.

The primary range of motion for the piriformis muscle and its synergists is external rotation. Functional exercises exist for these muscles; however, none are known to exercise these muscles against resistance in external rotation. It is commonly believed the piriformis and synergists do not need to be exercised at all, because they are overactive in most people. But in the case that the hip joint is internally rotated, the piriformis and synergists must be exercised against resistance to return the hip joint back to its proper position in the acetabulum.

The primary range of motion for the peroneals is evertion and plantar flexion. While it is generally accepted that the peroneals are short in most people, because most exhibit pronation rather than supination, in the case of supination or hypersupination, the peroneals must be exercised against resistance in external rotation and eversion while the foot is plantar flexed. Functional exercises exist for these muscles; however, none are known to exercise these muscles against resistance in external rotation and eversion while in plantarflexion.

SUMMARY OF INVENTION

A device to exercise the pelvis/hip complex in internal rotation, particularly the gluteus medius and gluteus minimus complex, is described. The device may also be used to exercise the posterior tibialis in internal rotation and plantar flexion, with stabilization of the knee. In addition, the device may be used in external rotation to exercise the piriformis muscle and its synergists as well as to exercise the peroneals muscles in external rotation and eversion, with stabilization of the knee.

The device is comprised of a rotatable foot support plate or disk that is positioned upon and supported by a stable base. The foot support plate supports the foot and provided internal rotational exercise resistance. A means to selectively vary the rotational resistance of the rotatable plate is provided.

The rotatable foot support plate is held and positioned on the base at a predetermined angle for to isolate the gluteus medius and gluteus minimus muscle group and the piriformis muscle and its synergists during the exercise. The base includes a pair of stationary foot pads positioned on opposite sides of the foot support disk. These stationary foot pads provide a predetermined support position for the foot opposite the foot to be exercised.

The device may also be provided with a selectively positionable elevated stationary foot support post. This foot support post is positioned on the base in a manner that will raise a user's foot and rest the non-working leg in a standing position while the other foot is supported on the rotatable foot support plate. The elevated foot support post is key as the non-working leg of the user is put in a position of simulated motion, which serves to properly load the muscles of the working leg to be exercised.

A hand rail system having an adjustable back plate is provided to stabilize the user's torso in the standing position and at a desired position with respect to the rotatable foot plate. This provides a guide to the user for proper orientation of the pelvis while exercising the gluteus medius/gluteus minimus complex. A belt is attached to the back plate to secure the user and force the user to use only the intended muscles during exercise in the standing position, and to make the user more aware of any compensation patterns while doing the exercise.

DESCRIPTION OF EMBODIMENT

Figure 1:
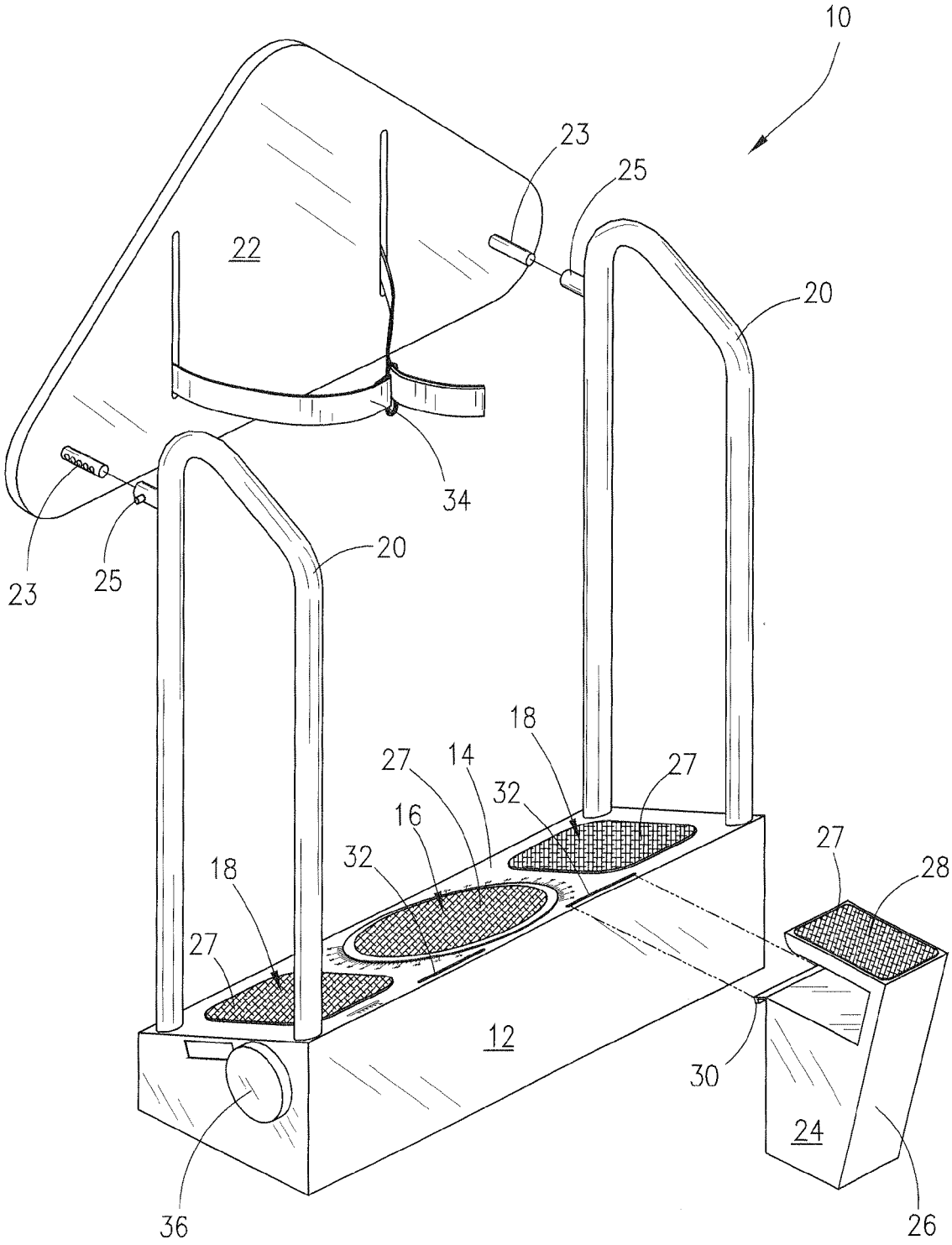
FIG. 1 is a front perspective exploded view of the exercise device described herein.
Figure 2:
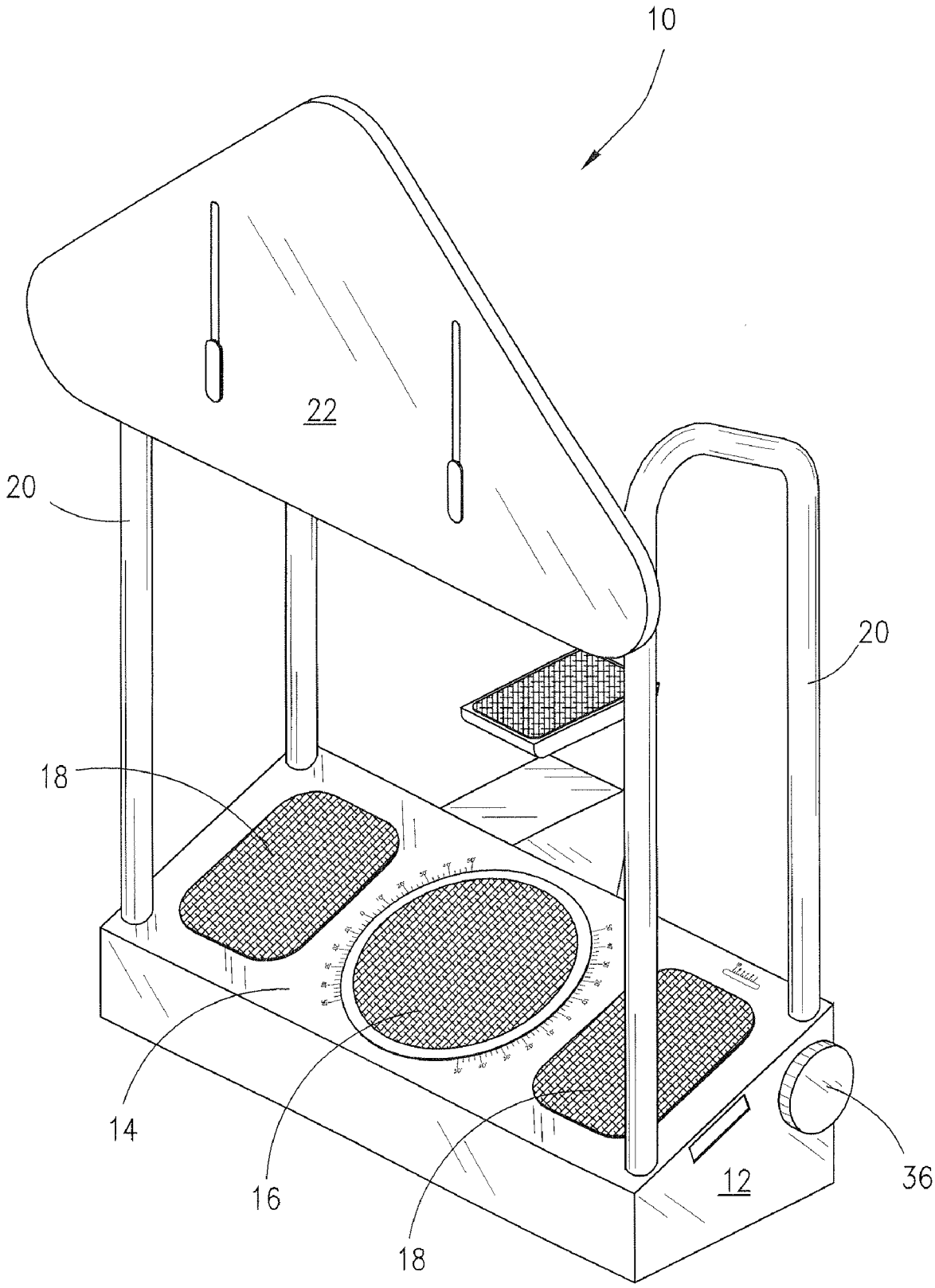
FIG. 2 is a back perspective view of the exercise device in FIG. 1.
Figure 3:
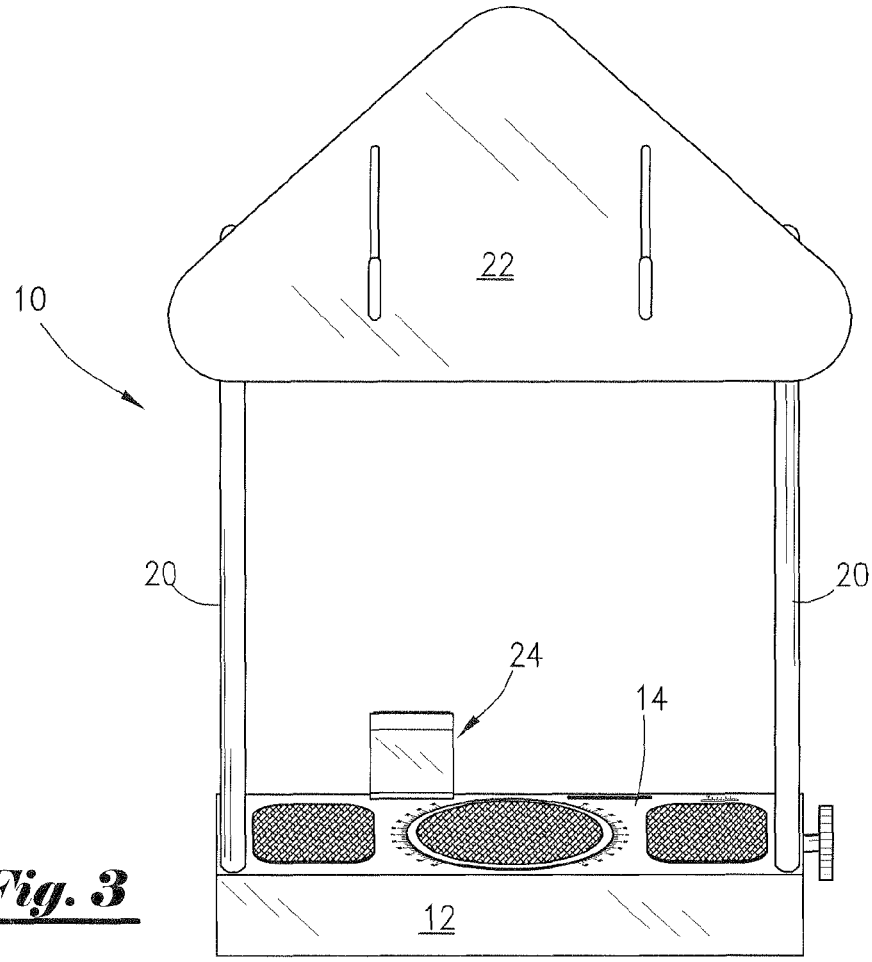
FIG. 3 is a back view of the exercise device of FIG. 1.
Figure 4:
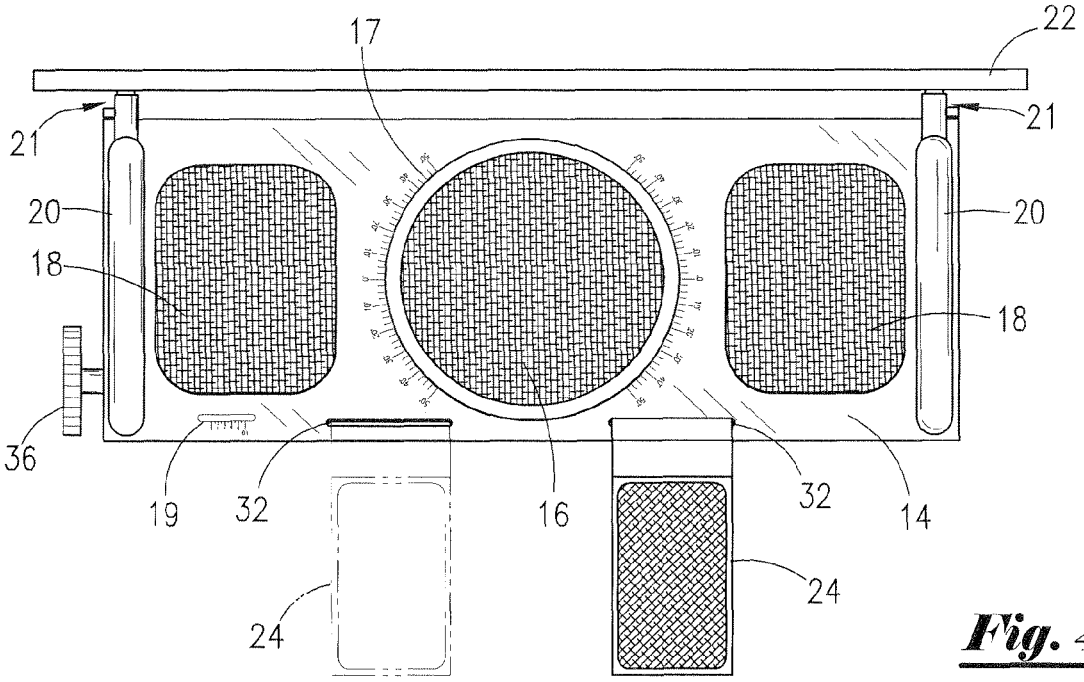
FIG. 4 is a top view of the exercise device of FIG. 1.

Referring now to the drawings, the exercise device of Applicant's invention is shown. Referring to FIGS. 1-4, the device (10) is comprised of a stationary base (12). The base (12) has a tilted top (14) and a rotatable turntable or foot support plate (16) supported above the base (12). Foot pads (18) are located on the top (14) on either side of the rotatable foot plate (16). The two foot pads (18) positioned on the top (14) are for pre-positioning and safety only.

Handrails (20) that extend vertically upward from the base (12) are provided on opposite each of the foot pads (18). The handrails (20) are angled for user support and balance during exercise. Attached to the handrails (20) is a back support (22). The back support (22), shown in the drawings as a vertically orientated plate, is positioned on the device (10) along the lower edge of the tilted top (14).

The back support (22) may be positioned toward and away from the base (12) and the rotatable foot plate (16) by back support plate adjustment means (21). This back support adjustment means (21) may be a sleeved pipe and set pin assembly mechanism (23) for sliding adjustment of the back support (22) along a horizontal bar (25) projecting from the handrails (20) though other adjustment mechanisms may be utilized as sleeved bar and set screw mechanism. The back support (22) provides a guide to the user for proper orientation of the pelvis while the device (10) is used to exercise the gluteus medius/gluteus minimus muscle complex.

The inwardly and outwardly adjustable back support (22) is intended to place the position of the pelvis in a neutral position during exercise. The neutral position of the pelvis is when the anterior and posterior-superior iliac spines are in the same horizontal plane with the anterior-superior iliac spines and the symphysis pubis in the same vertical plane.

Because not all users of the device (10) will be of the same size and shape, adjustment of the back support plate (22) to a proper position inward or outward from the base (12) and the rotatable foot support (16) is necessary. If the pelvis is not in the neutral position during the exercise, e.g., rotation of the foot plate (16), a series of five different muscle groups will inhibit the targeted muscles and make it impossible to exercise the gluteus medius/gluteus minimus muscle complex to its fullest potential.

A belt (34) is attached to the back support (22). The belt is used to secure and hold the user in a stable position against the back support (22) during use of the device (10) when the user is in a standing position for exercise of the pelvic/hip complex.

An elevated foot support (24) is mounted on said base at a position forward of and to the side of said rotatable foot support (16). The elevated foot support (24) has a pedestal (26) that supports a foot support (28) at a level above the base top (14). The surface of the foot support (28) is parallel to the floor surface. The foot support (24) has a key (30) that conforms to a slot (32) in the base (12) to hold the foot support (24) in place on the base (12). Multiple Slots (32) may be provided along the edge of the base (12) allow the foot support (24) to be detached and located either to the left or the right of the rotatable foot support (16) as desired.

The foot contact surfaces (27) of the foot support plate (16), foot pads (18) and the foot support (24) may be provided with anchor points such as non-skid surfaces or foot straps to help hold the feet in position during exercise.

The device (10) has a means (36) for applying adjustable rotational resistance or torque to the rotatable foot plate (16). This rotationally resistance may be supplied in both directions of rotation. This torque or rotational resistance may be supplied for example by a system of tension springs, coil springs, hydraulic or pneumatic cylinders, a system of cams and springs, or a system of disks and brakes to provide rotating resistance to the rotatable foot plate (16). Such means for applying rotational resistance are known and may be modified or supplied as desired.

Applicant has found that tilting the rotating foot plate (16) in order to dorsiflex the user's foot as the foot plate (16) is turned against resistance during internal and external rotation of the user's foot during an exercise session will improve results. It is believed that the dorsiflexion of the foot will weaken the muscles of the foot in this position, and therefore the internal rotation exercise will more specifically target the internal rotators of the hip, the gluteus medius/gluteus minimus complex. Applicant has found that tilting the rotating foot plate (16) in order to dorsiflex the user's foot at an angle in the range of six degrees to sixteen degrees will serve to specifically target the internal rotators of the hip though an angle of tilt of eleven degrees for the rotating foot plate (16) is believed to produce the best results.

Similarly, when the rotating foot plate (16) is tilted in order to plantarflex the user's foot as the foot plate (16) is turned against resistance during internal rotation of the foot will work the posterior tibialis muscle while the user is in the seated or the standing position. This plantarflex position while seated will properly align the posterior tibialis for strong contraction. Tilting the rotating foot plate (16) at an angle in the range of six degrees to sixteen degrees and rotating the foot plate (16) against resistance in order to plantarflex the foot being exercised, while the user is in a seated position, will serve to specifically target the posterior tibialis muscle though an angle of tilt of eleven degrees for the rotating foot plate (16) is believed to produce the best results.

Figure 5:
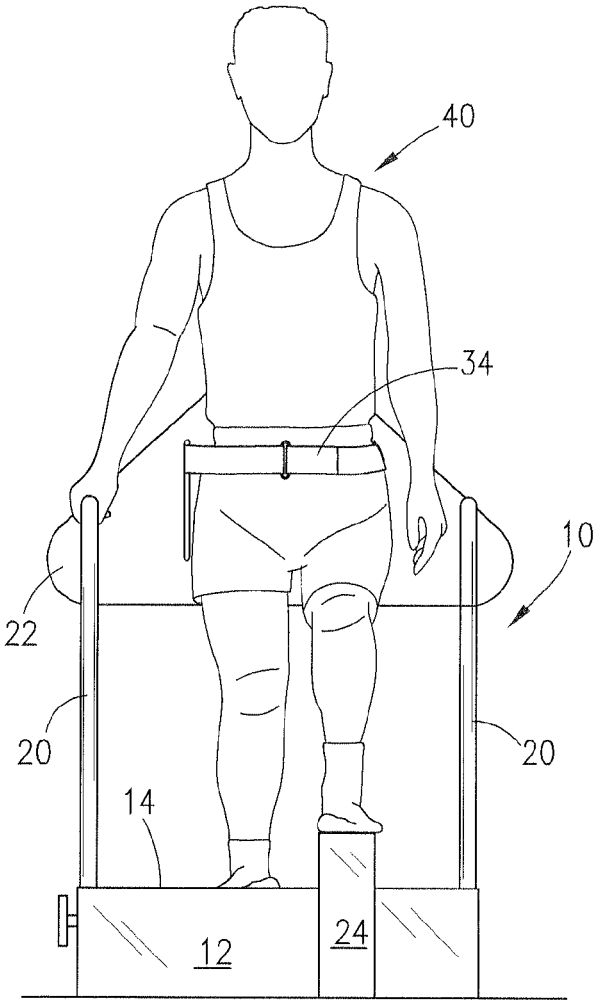
FIG. 5 is a front representative view of the device in use for exercise of the pelvic/hip muscle complex in the standing position.

FIG. 5, a view of the top (14) of the device (10) shows the rotatable foot plate (16) and the foot pads (18). The top (14) may be provided with graduations (17) to show the angle of rotation of the foot plate (16) as it is rotated during exercise. The top (14) may also be provided with a meter (19) to indicate the torque being applied by the user during rotation of the rotatable foot support plate (16). Mechanical, electronic, or hydraulic means may be used to measure and indicate the torque applied to the foot support plate (16).

The rotatable foot support plate (16) may be provided with a vibration attachment, not shown, to vibrate the rotatable foot support plate (16) during exercise. The vibration attachment may simply be an electromagnetic vibration device attached to the foot support plate (16). The vibration feature helps activate the muscles which are contracting to provide more action potentials during the time the muscles are being exercised. It is thought that a vibration attachment having a vibration frequency of 35 Hz and having a rotational wavelength will be utilized.

The device (10) is designed to exercise four muscle groups. The gluteus medius and gluteus minimus muscles are isolated and exercised with the user in a standing position with only internal rotation of the foot on the rotatable foot support plate (16). The piriformis muscle may be exercised with the user in a standing position with only external rotation of the foot on the rotatable foot support plate (16). The posterior tibialis is exercised with the user in a standing or seated position with only internal rotation of the foot on the rotatable foot support plate (16) with inversion of the rotating foot. The peroneals are exercised with the user in a standing or seated position with only external rotation of the foot on the rotatable foot support plate (16) with eversion of the foot.

Figure 6:
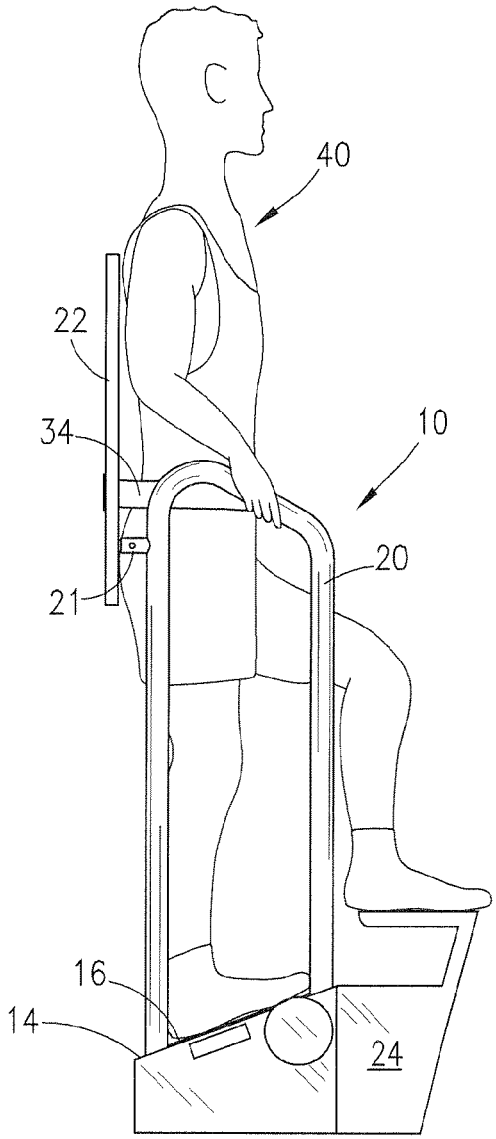
FIG. 6 is a front representative view of the device in use for exercise of the pelvic/hip muscle complex in the standing position.

The method of use of the device (10) to isolate and exercise the pelvis/hip complex against resistance in internal and external rotation, particularly the gluteus medius and gluteus minimus complex is shown in FIG. 6. The device (10) may be utilized to exercise one side of the user's body at a time.

For example, to exercise the gluteus medius and gluteus minimus complex of the user's right body side, the elevated foot support (24) is moved to left side of the rotatable foot support plate (16) and positioned and secured on the base (12) by means of the key (30) and the corresponding slot (32) in the base (12). The torsional resistance of the rotatable foot support plate (16) is adjusted with the torsional resistance adjustment means (36) so that the user will be exercising with a desired degree of torsional resistance to the plate (16).

The user (40) in a standing position then stands on the top (14) of the device (10) with the user's right foot on the rotatable foot support plate (16) and the user's left foot on the stationary foot support pad (18) to the left of the foot support (16). The stationary foot pad (18) serves to aid in alignment of the user's body for proper use of the device (10). The user's back is then positioned against the back support (22) and the position of the back support is adjusted inward or outward with respect to the rotating plate (16) by the back support adjustment means (21). In doing so, the user's pelvis is orientated with respect to the rotating foot support plate (16) to position of the user's pelvis in a neutral position during exercise. The belt (34) may then be attached to the back support (22) and the user (40) to secure and hold the user (40) in a stable position against the back support (22). The user (40) may use the handrails (20) to further stabilize his position on the device (10) for the exercise.

To begin the exercise of the gluteus medius/gluteus minimus complex on the user's right side, then places his left foot, the foot of the non-working leg, of the elevated foot support (24). Placement of the foot of the non-working leg on the elevated foot support (24) simulates gait and allows the user (40) to place all of his weight on the right foot and onto the rotatable foot support plate (16). The elevated foot support (24) forces the right leg, the leg being exercised, to bear most of the user's body weight while isolating the gluteus medius and gluteus minimus muscle group on that side of the user's body.

With the user's right foot placed flat upon the rotating foot support plate (16), with the right foot placed in dorsiflexion, and the toes up and with the user's left foot, the foot of the non-working leg, on the elevated foot support (24), and with the user (40) in a standing position, stabilized in a pelvic neutral position by the back support (22) and the handrails (20), the user (40) then rotates the right foot internally and in doing so turns the foot support rotatable plate (16). When the rotatable foot support plate (16) is turned and rotated from the top, the user (40) feels resistance against the rotation in the form of counter pressure.

The resistance against this rotation provided by the foot support plate (16) and the position of the right foot, which is in dorsiflexion due to the angle of the rotatable foot plate (16) isolates the gluteus medius and gluteus minimus muscle group of the user's right hip for exercise resistance. Dorsiflexion of the user's foot at an angle in the range of six degrees to sixteen degrees due to the angle of tilt of the foot support plate (16) serves to specifically target the internal rotators of the hip, though an angle of tilt of eleven degrees for the rotating foot support plate (16) is believed to produce the best results.

Depending upon the fitness and condition of the user, as an alternative exercise mode, a user (40) may place his left foot, the non-working foot, on the left foot pad (18) adjacent to the rotatable foot plate (16) rather than on the elevated foot support (24). The user (40) may then rotate the right foot on the rotatable plate (16) as described above for internal and external rotation of the pelvic/hip complex.

The exercise described above may be repeated to exercise the left side of the user's body by moving the elevated foot support (24) to the other side of the rotatable plate (16) and securing it to the base (12). The exercise steps may then be repeated for the left leg and pelvic/hip complex.

Repeating the exercise steps noted above but with rotation of the rotatable plate (16) externally will isolate and exercise the piriformis muscle of the working leg.

Figure 7:
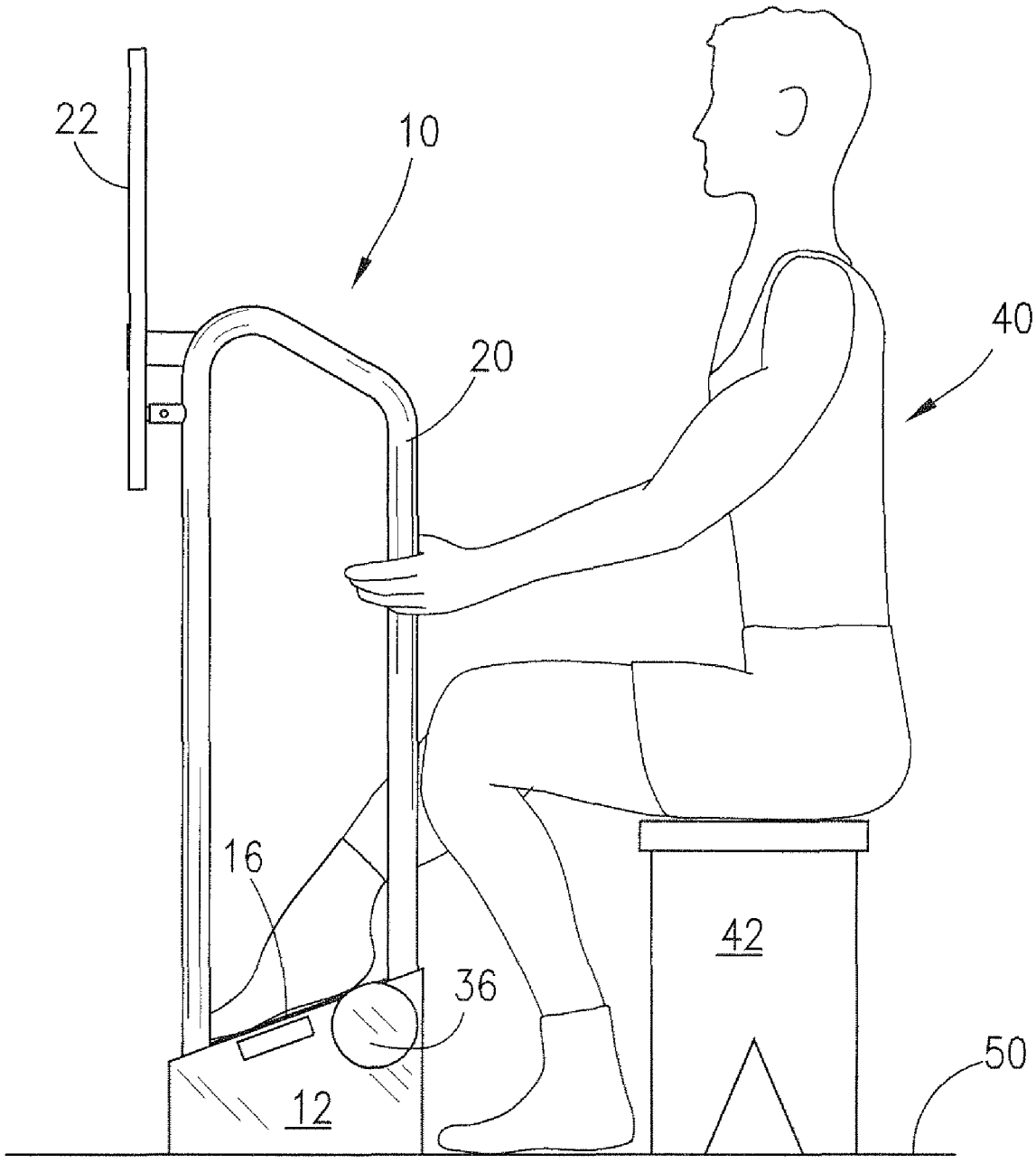
FIG. 7 is a side representative view of the device in use for exercise of the posterior tibialis in a sitting position.

The device (10) may be used for exercise of the posterior tibialis in internal rotation and inversion, with stabilization of the knee with the user in a sitting or standing position. For example, as shown in FIG. 7, to use the device (10) for exercise of the posterior tibialis in internal rotation and inversion, with stabilization of the knee, with the user in a sitting position, a chair or bench (42) is place in front of the device (10) so that when seated the upper legs of the user (40) are positioned parallel with the floor (50) with the heel of the foot of the leg to be exercised, here the right foot, on the rotatable foot support plate (16). The torsional resistance of the rotatable foot support plate (16) is adjusted with the torsional resistance adjustment means (36) so that the user will be exercising with a desired degree of torsional resistance to the plate (16).

The user (40) then sits on the bench (42) with his right heel on the rotatable foot support plate (16). The user (40) then flexes the right foot so that the right foot is flat against the rotatable foot support plate (16) in order to plantarflex the foot against the foot support plate (16). The user (40) may hold the handrails (20) so that the user (40) is stabilized in this position for the exercise.

With the right foot of the user (40) in plantarflexion upon the rotatable foot support plate (16), the right foot is rotated to rotate the support plate (16) against internal rotation and inversion resistance. This rotation will isolate and work the posterior tibialis muscle. Positioning the foot in plantarflexion while the user (40) is seated will properly align the posterior tibialis for strong contraction.

The user may also exercise of the posterior tibialis in internal rotation and inversion, with stabilization of the knee in standing position. To do so, the user stands in front of the device (10) with the heel of the foot of the leg to be exercised on the rotatable foot support plate (16). The handrails (20) may be utilized to stabilize the user if necessary. The user (40) then flexes the foot flat against the rotatable foot support plate (16) in order to plantarflex the foot against the foot support plate (16). The exercise is than performed as described above for the sitting position.

Plantarflexion of the user's foot at an angle in the range of six degrees to sixteen degrees due to the angle of tilt of the foot support plate (16) serves to specifically target the posterior tibialis muscle though an angle of tilt of eleven degrees for the rotatable foot support plate (16) is believed to produce the best results. The exercise described above may be repeated to exercise the posterior tibialis muscle of the left leg by positioning the user's left foot on the rotatable foot support plate (16) and repeating the exercise steps described.

As an alternative, the user (40) may stand and position the foot to be exercised onto the rotatable foot support plate (16) to place the foot in plantarflexion. Internal rotation of the foot support plate (16) against resistance from that position while standing will also serve to isolate and exercise the posterior tibialis.

With the user in a standing or a seated position, as described, the peroneals may exercised by repeating the above exercise steps but with external rotation of the foot on the rotatable foot support plate (16) with eversion of the foot.

Vibration of the rotatable foot support plate (16) during the exercise steps described above may be added as an additional step in each exercise sequence. Vibration of the rotatable foot support plate (16) serves to activate the muscles which are contracting to provide more action potentials during the time the muscles are being exercised. A vibration frequency of 35 Hz with a rotational wavelength is suggested.

It is believed that the method and apparatus of the present invention, including the invention's advantages, will be understood from the foregoing description. It is also believed that it will be apparent that changes could be made in the arrangement of the invention's parts or steps with departing from its spirit and scope. The description contained herein is merely intended to provide an exemplary embodiment of the invention.

The invention claimed is:

1. An exercise apparatus comprising:

(a) a stable base, (b) a rotatable foot support plate mounted on said base at a predetermined angle, said foot support plate having a resistance to rotation;

(c) an elevated foot support plate mounted on said base at a position forward of and to the side of said rotatable foot support, said elevated foot support plate providing a foot support surface elevated above said rotatable foot support plate; and (d) a back support, said back support being selectively positionable horizontally, toward and away from said base.

2. The apparatus as recited in claim 1, further comprising a means for selectively varying the rotational resistance of said rotatable foot support plate.

3. The apparatus as recited in claim 2, further comprising handrails mounted to said base, said handrails extending on either side of said rotatable foot support plate.

4. An exercise apparatus comprising:

(a) a stable base, (b) a rotatable foot support plate mounted on said base at a predetermined angle, said foot support plate having a resistance to rotation;

(c) an elevated foot support plate wherein said elevated foot support may be selectively positioned on said base at a position forward of and to the side of said rotatable foot support, said elevated foot support plate providing a foot support surface elevated above said rotatable foot support plate;

(d) a back support, said back support being selectively positionable horizontally, toward and away from said base;

(e) a means for selectively varying the rotational resistance of said rotatable foot support plate; and (f) handrails mounted to said base, said handrails extending on either side of said rotatable foot support plate.

5. The apparatus as recited in claim 4, further comprising a belt mounted to said back support.

6. The apparatus as recited in claim 5, further comprising means for vibrating said rotatable foot plate.

7. An exercise apparatus comprising:

(a) a stable base, said base having a forward edge and a rear edge and a top, said top being tilted upward at a predetermined angle from the horizontal from said rear edge of said base;

(b) a rotatable foot support plate mounted on said top of said base at an angle to coincide with said angle of said top of said base;

(c) foot support pads mounted on said base on each side of said rotatable foot support plate;

(d) means for selectively varying the rotational resistance of said foot support plate;

(e) an elevated foot support mounted to said base along said forward edge of said base and forward from and to the side of said rotatable foot support plate;

(f) handrails mounted to said base, said handrails extending on either side of said rotatable foot support plate; and (g) a back support mounted on said base at a position vertically away from said base, said back support being slidably positionable horizontally toward and away from said rear edge of base.

8. The apparatus as recited in claim 7, further comprising means for vibrating said rotatable foot plate at a frequency of at least 35 Hz.

9. The apparatus as recited in claim 7, further comprising:

(a) a belt support mounted to said back support; and (b) means for preventing skidding mounted to said rotatable foot support plate and said elevated foot support.

10. The apparatus as recited in claim 1 wherein said predetermined angle of said foot support plate is between 6 and 16 degrees from the horizontal.

11. The apparatus as recited in claim 7 wherein said predetermined angle of said foot support plate is between 6 and 16 degrees from the horizontal.

12. The apparatus as recited in claim 1 wherein said predetermined angle of said foot support plate is 11 degrees.

13. The apparatus as recited in claim 7 wherein said predetermined angle of said foot support plate is 11 degrees.

14. A method for exercise of the gluteus medius and gluteus minimus muscle complex comprising:

(a) providing a rotatable foot support plate, said rotatable foot support plate having adjustable resistance to rotation;

(b) positioning said rotatable foot plate at an angle from the horizontal;

(c) providing a back support;

(d) adjusting said rotatable foot support plate to a desired rotational resistance;

(e) standing a user in a position between said rotatable foot support and said back support with said user's pelvis in a neutral position;

(f) placing said user's working foot in dorsiflexion upon said rotatable foot support plate and placing said user's non-working foot in a stationary position aside said rotatable foot plate;

(g) supporting said user's back with said back support;

(h) supporting said user's weight on said user's working foot upon said rotatable foot support plate while said user's foot in dorsiflexion; and (i) rotating said user's foot internally against said rotational resistance of said rotatable foot support plate whereby said rotational resistance of said rotatable foot support plate isolates the gluteus medius and gluteus minimus muscle group of the user's hip for exercise resistance.

15. A method for exercise of the gluteus medius and gluteus minimus muscle complex comprising:

(a) providing a rotatable foot support plate, said rotatable foot support plate having adjustable resistance to rotation;

(b) positioning said rotatable foot plate at an angle from the horizontal;

(c) providing a back support;

(d) adjusting said rotatable foot support plate to a desired rotational resistance;

(e) providing an elevated foot support forward of and to the side of said rotatable foot support plate, said elevated foot support plate providing a foot support surface elevated above said rotatable foot support plate;

(f) standing a user in a position between said rotatable foot support and said back support with said user's pelvis in a neutral position;

(g) placing said user's working foot in dorsiflexion upon said rotatable foot support plate whereby said user's weight is supported by said user's working foot on said rotatable foot support plate;

(h) placing said user's non-working foot on said elevated foot support thereby simulating gate;

(i) supporting said user's back with said back support;

(j) supporting said user's weight upon said rotatable foot support plate while said user's working foot is in dorsiflexion; and (k) rotating said user's working foot internally against said rotational resistance of said rotatable foot support plate whereby said rotational resistance of said rotatable foot support plate isolates the gluteus medius and gluteus minimus muscle group of the user's right hip for exercise resistance.

16. A method for exercise of the gluteus medius and gluteus minimus muscle complex comprising:

(a) providing a rotatable foot support plate, said rotatable foot support plate having adjustable resistance to rotation;

(b) positioning said rotatable foot plate at an angle from the horizontal;

(c) providing a back support;

(d) adjusting said rotatable foot support plate to a desired rotational resistance;

(e) providing an elevated foot support forward of and to the side of said rotatable foot support plate;

(f) standing a user in a position between said rotatable foot support and said back support with said user's pelvis in a neutral position;

(g) placing said user's working foot in dorsiflexion upon said rotatable foot support plate;

(h) supporting said user's non-working foot on said elevated foot support;

(i) supporting said user's back with said back support;

(j) supporting said user's weight upon said rotatable foot support plate while said user's working foot is in dorsiflexion;

(k) rotating said user's working foot internally against said rotational resistance of said rotatable foot support plate;

(l) providing handrails;

(m) providing means for adjusting the position of said back support horizontally with respect to rotatable foot support plate;

(n) supporting said user with said handrails; and (o) adjusting said back support to said user's back with said user's pelvis in said neutral position.

17. The method as recited in claim 14 wherein said step of placing said user's foot in dorsiflexion upon said rotatable foot support plate includes placing said foot in dorsiflexion at an angle between 6 and 16 degrees.

18. The method as recited in claim 14 wherein said step of placing said user's foot in dorsiflexion upon said rotatable foot support plate includes placing said foot in dorsiflexion at an angle of 11 degrees.

19. The method as recited in claim 16 wherein said step of placing said user's foot in dorsiflexion upon said rotatable foot support plate includes placing said foot in dorsiflexion at an angle between 6 and 16 degrees.

20. The method as recited in claim 16 wherein said step of placing said user's foot in dorsiflexion upon said rotatable foot support plate included placing said foot in dorsiflexion at an angle of 11 degrees.

21. The method as recited in claim 19 including the additional step of vibrating said rotatable foot support plate while said user's foot is rotating said rotatable foot support plate against resistance.

22. The method as recited in claim 20 including the additional step of vibrating said rotatable foot support plate while said user's foot is rotating said rotatable foot support plate against resistance.

23. A method for exercise of the posterior tibialis comprising:

(a) providing a rotatable foot support plate, said rotatable foot support plate having adjustable resistance to rotation;

(b) providing a stable base and positioning said rotatable foot plate on said stable base whereby said rotatable foot plate is held and positioned on said stable base at a pre-determined angle from the horizontal;

(c) providing a seat;

(d) adjusting said rotatable foot support plate to a desired rotational resistance;

(e) seating a user upon said seat in a position adjacent to said rotatable foot support;

(f) placing said user's foot upon said rotatable foot support plate in plantarflexion against said rotatable foot support plate; and (g) rotating said user's foot internally with inversion against said rotational resistance of said rotatable foot support plate.

24. The method recited in claim 23 wherein said step of placing said user's foot upon said rotatable foot support plate in plantarflexion against said rotatable foot support plate includes placing said foot in plantarflexion at an angle between 6 and 16 degrees.

25. The method as recited in claim 24 wherein said step of placing said user's foot upon said rotatable foot support plate in plantarflexion against said rotatable foot support plate includes placing said foot in plantarflexion at an angle of 11 degrees.

26. A method for exercise of the posterior tibialis comprising:

(a) providing a rotatable foot support plate, said rotatable foot support plate having adjustable resistance to rotation;

(b) providing a stable base and positioning said rotatable foot plate on said stable base whereby said rotatable foot plate is held and positioned on said stable base at a pre-determined angle from the horizontal;

(c) providing a seat;

(d) adjusting said rotatable foot support plate to a desired rotational resistance;

(e) seating a user upon said seat in a position adjacent to said rotatable foot support;

(f) placing said user's foot upon said rotatable foot support plate in plantarflexion against said rotatable foot support plate at an angle between 6 and 16 degrees;

(g) rotating said user's foot internally with inversion against said rotational resistance of said rotatable foot support plate; and (h) vibrating said rotatable foot support plate while said user's foot is rotating said rotatable foot support plate against resistance.

27. The method of claim 15 further comprising the step of rotating said user's foot externally against said rotational resistance of said rotatable foot support plate for exercise of the piriformis muscle.

28. A method for exercise of the posterior tibialis comprising:

(a) providing a rotatable foot support plate, said rotatable foot support plate having adjustable resistance to rotation;

(b) providing a stable base and positioning said rotatable foot plate on said stable base whereby said rotatable foot plate is held and positioned on said stable base at a pre-determined angle from the horizontal;

(c) providing a seat;

(d) adjusting said rotatable foot support plate to a desired rotational resistance;

(e) seating a user upon said seat in a position adjacent to said rotatable foot support;

(f) placing said user's foot upon said rotatable foot support plate in plantarflexion against said rotatable foot support plate at an angle of 11 degrees; and (g) rotating said user's foot internally with inversion against said rotational resistance of said rotatable foot support plate; and (h) providing means for vibrating said rotatable foot support plate and vibrating said rotatable foot support plate while said user's foot is rotating said rotatable foot support plate against resistance.

29. The method of claim 23 further comprising the steps of placing said user's foot in pronation and rotating said user's foot externally with eversion against said rotational resistance of said rotatable foot support plate with for exercise of the peroneal muscles.

* * * * *